United States Patent [19]

Ruppert et al.

[11] Patent Number: 4,620,551

[45] Date of Patent: Nov. 4, 1986

[54] APPARATUS FOR MANUALLY FILLING CIGARETTE TUBES

[75] Inventors: Heinrich W. Ruppert, Trossingen; Klaus Gätschmann, Bad Dürrheim, both of Fed. Rep. of Germany

[73] Assignee: Efka-Werke Fritz Kiehn GmbH, Trossingen

[21] Appl. No.: 680,603

[22] Filed: Dec. 10, 1984

[30] Foreign Application Priority Data

Dec. 10, 1983 [DE] Fed. Rep. of Germany ..... 3344682

[51] Int. Cl.[4] ..... A24C 5/42

[52] U.S. Cl. ..... 131/75; 131/70

[58] Field of Search ..... 131/75, 70

[56] References Cited

U.S. PATENT DOCUMENTS 3,783,882 1/1974 Messner et al. ..... 131/70

*Primary Examiner*—V. Millin

*Attorney, Agent, or Firm*—Browdy and Neimark

[57] ABSTRACT

In an apparatus for filling cigarette tubes in particular filter cigarette tubes, comprising a casing having a tobacco compressing chamber disposed in the longitudinal direction thereof, a coverlike press bar associated with this tobacco compressing chamber and located in a cover, that covers the casing housing and hinged on a shaft, as well as an ejector pusher for introducing a pressed plug of cut tobacco into a cigarette tube, that is intermittently retained by clamping on a short socket, the clamping device is intended to be embodied such that the clamping operation is completely divided from the filling operation, wherein the functional reliability of the individual elements of the filling apparatus is increased without making the apparatus less convenient to use.

This is attained by providing spring-loaded clamping element 10 for a cigarette tube placed on a short socket 9, the clamping element 10 being independent of the cover 6 and pusher 7, by a manual pushbutton 2 is urged laterally against the short socket 9. As a result, when filling the cigarette tube the user automatically actuates the clamping element 10, and the clamping operation is ended by the user at the end of the filling operation.

10 Claims, 4 Drawing Figures

FIG. 1
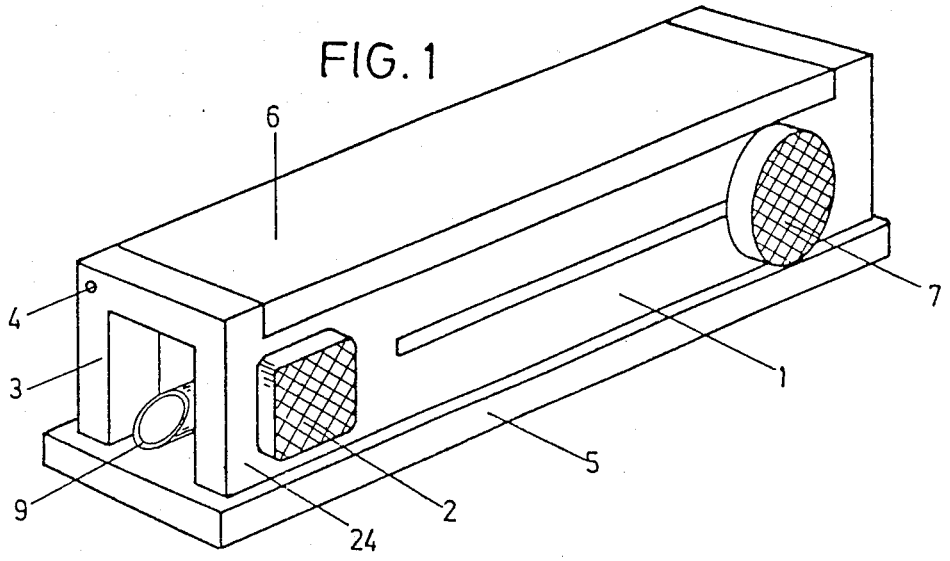
FIG. 2
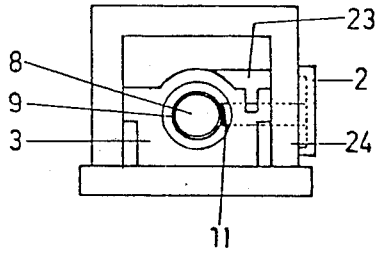
FIG. 3
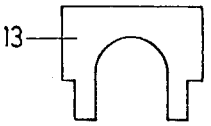
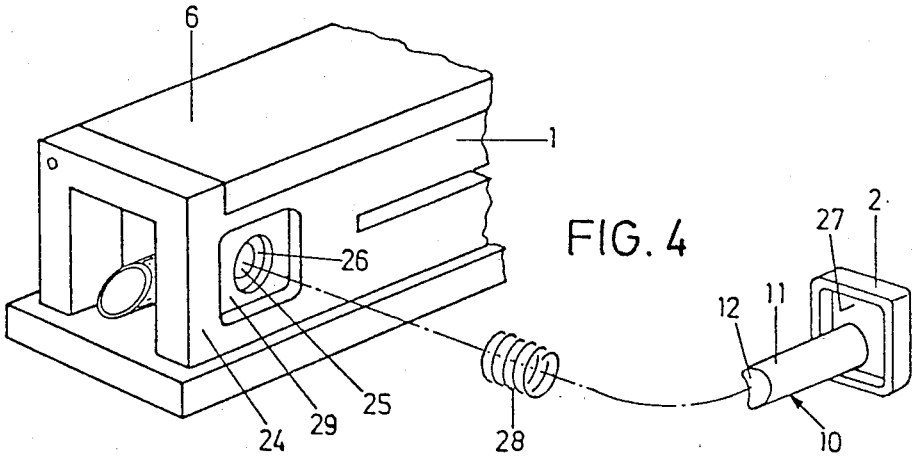
FIG. 4

APPARATUS FOR MANUALLY FILLING CIGARETTE TUBES

FIELD OF THE INVENTION

The present invention relates to an apparatus for manually filling cigarette tubes, in particular filter cigarette tubes, comprising a casing having a tobacco compressing chamber disposed longitudinally of the casing; a cover-type press bar, associated with the compressing chamber and located in a cover that covers the casing and is swingable about an axis for being opened and closed; and an ejector slide for introducing a pressed plug of cut smoking tobacco into a cigarette tube that is intermittently retained on a short socket by clamping.

BACKGROUND OF THE INVENTION

Cigarette filling devices of the above type are known in many forms. Attempts have heretofore been made to trigger or actuate as many functions of such a device as possible by means of a single element; difficulties arise, however, particularly in cases, where the clamping device is actuated either directly or indirectly by the cover, because various tolerances and other indefinite factors have a cumulative effect.

It has already been proposed that a division of the actuation functions be made. Despite this devision, there remains a need for simplifying the actuation and increasing the functional reliability of the device.

SUMMARY OF THE INVENTION

It is accordingly the object of the present invention to divide the clamping process completely from the filling operation and, without making the device less convenient to use, to improve these functions and increase the functional reliability of the individual elements of the cigarette filling apparatus.

This object is exentially attained in accordance with the present invention by providing a spring-loaded clamping element for a cigarette tube placed on the short socket normally provided for holding the cigarette tube. The clamping element is independent of the cover and the pusher is actuated by a manual pushbutton located laterally of the short socket.

As a result of the invention, it is possible to use a cover of any shape for closing the tobacco compressing chamber, and a pusher, spoon or the like of any arbitrary configuration for introducing the pressed plug of cut tobacco into a cigarette tube. The clamping of the cigarette tube, however, is effected not by means of the actuation of the cover or pusher, but by a manipulation of the device which is already necessary in the filling process.

The manual cigarette filling device according to the present invention must rest on a secure surface and be held firmly be the user when it is actuated. Generally this is done by firmly holding the front end of the casing with one hand, while actuating the cover and then the pusher with the other hand. As a result of the use of a clamping element according to the invention, which engages the short socket laterally via a manual actuation knob, the clamping process is initiated by the user of the apparatus, and the clamping is likewise maintained by the user during the filling operation. By replacing the clamping mechanism previously used with a clamping device actuable by the user, it is attained that the sense of touch or pressure of the user is brought into play and a feeling for the filling operation is provided so that at the end of filling operation, the clamping process can be terminated or interrupted by the user.

In a preferred embodiment of the invention, the clamping element is advantageously embodied integrally with the manual pushbutton.

To improve clamping, it is advantageous for the clamping element to be concave on its end facing the short tube.

The clamping element is advantageously guided in a retaining element that can be connected to the front wall of the casing.

By means of this embodiment, a simple structure is attained, which enables a simple assembly of the parts of the clamping device.

In a particularly suitable manner, the retaining element is fork-like. As a result, a twist-free guidance of the clamping element is effected, and a limited displacement path is provided for the manual pushbutton, thereby preventing an ejection of the manual pushbutton by a compression spring.

In an advantageous manner, a guide strip for the retaining element is provided, which engages a slit between the arms of the fork-like retaining element and is disposed between the front and side walls of the casing thereby facilitating assembly.

In a further embodiment of the invention, a compressing spring is disposed between a step-like support and the inside of the manual pushbutton, the step-like support being disposed in an opening for the pushbutton pin in an indentation in the side wall of the casing.

Further characteristics and advantages of the invention will be explained in detail below in conjunction with the drawing, which shows an exemplary embodiment in schematic form.

BRIEF DESCRIPTION OF THE DRAWING

FIG. 1 is a perspective view of an apparatus according to the present invention;

FIG. 2 is an end view of an apparatus as shown in FIG. 1;

FIG. 3 is an end view of a fork-like retaining element, and

FIG. 4 shows the embodiment of the spring loading means for the manual pushbutton, in an exploded view.

DESCRIPTION OF THE PREFERRED EMBODIMENT

Referring now to FIG. 1, there is shown a manual cigarette filling device in accordance with the present invention which includes a casing 1, a cover 6 hinged on a shaft 4 supported in a front casing wall 3 for pivoting the cover into opened and closed positions, and a pusher 7 for filling means, for instance a spoon, which introduces a plug of cut tobacco, which has been pressed in a tobacco compressing chamber disposed in the casing 1, into a cigarette tube. The casing 1 is advantageously disposed on a base 5. A manual pushbutton 2 is provided on one side wall 24, on the front end of the casing 1, which is biased out of the casing 1 to a certain extent by a spring device. When the pushbutton is pushed in, a clamping device (descriped below) firmly holds a cigarette tube on a short socket 9, located near the front wall 3.

The clamping device is shown in FIG. 2 in an end view of the casing 1.

An opening 8 accessed through the front casing wall 3 leads to a tobacco compressing chamber. The opening 8 is surrounded by a short socket 9, onto which an empty cigarette tube is first pushed to begin filling operation. Clamping is effected by a clamping element (see FIG. 4), which is actuatable by the manual pushbutton 2 supported in the side casing wall 24. A guide strip 23 extending toward the side casing wall 24 is provided on the front wall 3. A retaining element 13 is pushed onto this guide strip 23, which engages a slit between two arms of the forked retaining element 13. The two arms embody a guide for the lateral introduction of clamping element 10.

In FIG. 3, the retaining element 13 is shown in an end view as it is disposed in front of the front casing protrudes into the recess between the arms of the wall 3 when in the assembled state, and the short tube 9 retaining element 13.

In FIG. 4 is an exploded view of the clamping device shown with its individual parts assembled together with the side wall 24 of the casing 1. The side casing wall 24 preferably rectangular or square indentation 29. An opening 25 for a pin 11 carried by a pushbutton 2 is provided in the side casing wall 24. The pin 11 is embodied integrally with the manual pushbutton 2 and forms the clamping element 10. The pin 11 is concave on its end 12 facing the short socket 9, so as to facilitate or assure the clamping of a tube on the short socket 9.

In the finally assembled state, a compression spring 28 is provided between a step-like support 26, which surrounds the opening 25 for the pin 11, and the inside 27 of the manual pushbutton 2.

In the manual filling apparatus according to the invention, the clamping device functions as follows:

The apparatus is placed by the user with the base 5 on a firm support. Then the cover 6 is pivoted about the shaft 4 and the tobacco compressing chamber is opened. The user fills this tobacco compressing chamber (not shown) with the required amount of tobacco and closes the cover 6. The tobacco is then pressed in the compressing chamber into a plug of tobacco. By means of the pusher 7, which may be combined with a tamping rod, a spoon or the like, the plug of tobacco is next pushed into a tube, (not shown) which is firmly clamped to the short socket 9.

Deviating from the exemplary embodiment of FIG. 1, the cover 6 may instead be disposed such that it is pivotable about a shaft extending perpendicular to the longitudinal axis of the casing 1.

The embodiment may also be such that with the plug of tobacco remaining motionless, a cigarette tube is drawn over the tobacco.

After the tobacco is placed in the compression chamber, the device is pressed firmly against the support by one of the user's hands (e.g. the left hand), while the other hand (ie the right hand) actuates the pusher 7. At a point where the user would normally firmly hold the device, the manual pushbutton 2, provided in accordance with the invention, is now employed; this pushbutton 2, along with the other elements, embodies the clamping device. By firmly holding the casing 1, the user virtually automatically presses the manual pushbutton 2 into the interior of the casing 1. Counter to the action of the spring 28, and the cigarette tube pushed onto the short socket 9 is clamped firmly with the concave front surface 12. Toward the end of the filling operation, which can be recognized either visually from the position of the pusher 7 or from the increasing resistance to inserting the plug of tobacco into the cigarette tube, the user must reduce the pressure on the manual pushbutton 2, so that at the end of the filling operation the cigarette tube, now filled with tobacco, can be ejected from the short socket 9, without causing damage to the end of the cigarette tube.

The invention is not limited to the exemplary embodiments described and shown herein; instead, it encompasses all modifications and partial and subcombinations of the features and provisions described and/or shown which are within the competence of one skilled in the art.

What is claimed is:

1. A manual apparatus for filling a cigarette tube with tobacco, in particular filter cigarette tubes, comprising:
   - a casing having a tobacco compressing chamber disposed longitudinally of said casing;
   - a coverlike pressing bar associated with said tobacco compressing chamber and located in a cover covering, and hinged to, the casing;
   - a short socket disposed in said casing for holding an empty cigarette tube;
   - an ejector pusher for introducing a pressed plug of tobacco into a cigarette tube retained on said short socket by intermittent clamping; and
   - a spring-loaded clamping element for retaining the cigarette tube pushed onto the short socket, said clamping element being independent of said cover and pusher, and being urged by a manual pushbutton into its retaining location laterally of said short socket.

2. An apparatus as defined by claim 1, wherein said clamping element comprises a pin embodied integrally with, and extending from, the manual pushbutton.

3. An apparatus as defined by claim 1, wherein said clamping element is concave on its end facing the short socket.

4. An apparatus as defined by claim 2, wherein the free end of said pin is concave.

5. An apparatus as defined by claim 1, wherein said clamping element is guided in a retaining element, the latter being connectable with a front wall of said casing.

6. An apparatus as defined by claim 2, wherein said clamping element is guided in a retaining element, the latter being connectable with a front wall of said casing.

7. An apparatus as defined by claim 3, wherein said clamping element is guided in a retaining element, the latter being connectable with a front wall of said casing.

8. An apparatus as defined by claim 5, wherein said retaining element is fork-like in embodiment and secures said clamping element against twisting.

9. An apparatus as defined by claim 8, wherein a guide strip engages a slit between the arms of the fork-like retaining element and is disposed between said front wall and a side wall of said casing.

10. An apparatus as defined by claim 9, wherein a compression spring is disposed between a step-like support, disposed in an opening for said pin in an indentation of said side casing wall, and the surface of said manual pushbutton facing said sidewall.

* * * * *